US005170955A

United States Patent [19]

Grecksch et al.

[11] Patent Number: 5,170,955

[45] Date of Patent: Dec. 15, 1992

[54] TEXTILE WINDING MACHINE HAVING AN OPERATOR ACCOMMODATING PACKAGE READYING ASSEMBLY

[75] Inventors: Hans Grecksch; Josef Derichs; Martin Hamacher; Dietmar Engelhardt, all of Monchen-Gladbach; Rene Bucken, Grefrath, all of Fed. Rep. of Germany

[73] Assignee: W. Schlafhorst AG & Co., Moenchengladbach, Fed. Rep. of Germany

[21] Appl. No.: 717,626

[22] Filed: Jun. 19, 1991

[30] Foreign Application Priority Data

Jun. 19, 1990 [DE] Fed. Rep. of Germany ..... 4019475

[51] Int. Cl.[5] ..... B65H 67/06; B65H 54/20

[52] U.S. Cl. ..... 242/35.5 A; 242/35.5 R

[58] Field of Search ..... 242/35.5 A, 35.5 R

[56] References Cited

U.S. PATENT DOCUMENTS

| | | | |
|---|---|---|---|
| 4,544,107 | 10/1985 | Matsui et al. | 242/35.5 A |
| 4,576,341 | 3/1986 | Matsui et al. | 242/35.5 A |
| 4,601,434 | 7/1986 | Mori et al. | 242/35.5 A |
| 4,742,967 | 5/1988 | Sanno et al. | 242/35.5 A |
| 4,781,334 | 11/1988 | Derichs | 242/35.5 A |
| 5,011,000 | 4/1991 | Kawasaki et al. | 242/35.5 A X |
| 5,056,725 | 10/1991 | Wirtz et al. | 242/35.5 A |
| 5,056,726 | 10/1991 | Grecksch et al. | 242/35.5 A |
| 5,078,329 | 1/1992 | Grecksch et al. | 242/35.5 A |

FOREIGN PATENT DOCUMENTS

| | | |
|---|---|---|
| 1278308 | 9/1968 | Fed. Rep. of Germany . |
| 2650699 | 5/1978 | Fed. Rep. of Germany . |
| 3213253 | 10/1982 | Fed. Rep. of Germany . |

*Primary Examiner*—Stanley N. Gilreath

*Attorney, Agent, or Firm*—Shefte, Pinckney & Sawyer

[57] ABSTRACT

A textile winding machine is provided having an operator accommodating package readying assembly on which individual tube support members are supported at a convenient height to thereby provide an operator with ready access to the tubes or yarn packages supported on the tube support members. The textile winding machine includes a common exit path component along which tube support members are transported after unwinding of the feed packages supported thereon at the winding units of the textile winding machine and an entry conveyor device for raising the tube support members in spaced apart manner from the common exit path component with the tubes or yarn packages out of interference with one another to a feed package re-supply support assembly extending longitudinally along the textile winding machine at a height generally at the waist level of an average operator. During regular re-supply rounds, for example, an operator can conveniently transfer fresh feed packages from a rolling container or other storage device to the empty tube support members supported at waist level and the operator can manually prepare the yarn ends of any partial feed packages as well. A return conveyor allows recirculation of tube support members in a closed loop.

20 Claims, 4 Drawing Sheets

TEXTILE WINDING MACHINE HAVING AN OPERATOR ACCOMMODATING PACKAGE READYING ASSEMBLY

BACKGROUND OF THE INVENTION

The present invention relates to a textile winding machine having an operator accommodating package readying assembly and, more particularly, to a textile winding machine which circulates individual tube support members that support empty tubes, partial yarn packages, or full yarn packages in a closed loop that includes supporting the individual tube support members in a portion of the closed loop at a convenient height for providing an operator with ready access to the tube or yarn packages.

In one known type of textile machine arrangement, the delivery and discharge of yarn packages to and from the winding units of the machine are substantially completely automatic operations, except for manual doffing whereby an operator removes empty tubes by hand and supplies full yarn packages. In one arrangement of this type of textile winding machine, a so-called round magazine is provided which supplies a new feed package to a supply package delivery portion of the textile machine in response to an indication that the supply of feed packages awaiting winding at the winding units is in need of replenishment. The round magazine includes a plurality of pockets each for storing a feed package in readiness for supply to the feed package delivery portion of the textile winding machine and the round magazine itself must eventually be re-supplied with fresh feed packages after it has supplied its full complement of stored feed packages to the feed package delivery portion.

One situation which can occur in a textile winding machine arrangement including a round magazine is a situation in which the winding unit or the group of winding units being supplied by the round magazine encounter a relatively high number of partial feed packages or feed packages whose yarn ends cannot be successfully engaged by the winding unit or units. In this situation, the winding unit or units discharge the partial feed packages or unsuccessfully engaged feed packages without winding the yarn therefrom and request new feed packages to be supplied by the round magazines. Accordingly, the round magazine supplying the respective winding unit or group of winding units experiencing unwindable feed packages is emptied at a relatively faster rate than the other round magazines and this can lead to a production slowdown or shutdown if the particular round magazine becomes empty significantly prior to the time at which the round magazines are cyclically re-supplied with feed packages. As can be understood, the winding unit or group of winding units associated with the round magazine which has become rapidly empty stand idle during the time between the emptying of the round magazine and the re-supply of the round magazine during the cyclic re-supplying of the round magazines. German Patent Documents DE-B 12 78 308 and DE-A 26 50 699 each disclose textile machine arrangements designed to accommodate manual package re-supply operations in which an operator replenishes the full yarn packages.

U.S. Pat. No. 4,601,434 to Mori et al discloses an apparatus for transporting packages doffed from a spinning frame to a textile winding machine and the apparatus includes a horizontal portion located at a height for the convenience of an operator. Each of the winding units of the textile winding machine includes a through-path extending between a delivery path and an exit path for delivering yarn packages individually supported on peg trays to the winding unit and for transporting the peg trays to the exit path following unwinding of the yarn from the yarn packages by the winding units. The downstream end of the exit path is connected to the horizontal portion at which an operator performs manual doffing operations to doff the empty bobbins from the peg trays and place fresh yarn packages on the empty peg trays. The horizontal portion is connected to the entrance path as well so that the peg trays travel in a continuous loop between the winder and the horizontal portion at which the operator performs the manual operations. The horizontal portion at which the manual operations are performed as well as the inclined sections which raise the peg trays from the exit path to the horizontal portion and lower the peg trays from the horizontal portion to the entrance path are located at one longitudinal end of the textile winding machine. Accordingly, the space requirements of a textile winding machine incorporating the Mori et al apparatus are greater than those of a textile winding machine without such an apparatus. Accordingly, the need exists for a textile winding machine arrangement in which a sufficient supply of feed packages to the winding units can be assured and which additionally offers the advantages that an operator can conveniently monitor the replenishment needs of the textile winding machine and can readily attend to the re-supply of the textile winding machine with fresh feed packages in a manual operation.

SUMMARY OF THE INVENTION

The present invention provides a textile winding machine arrangement which assures a sufficient supply of feed packages to the winding units and, additionally, permits an operator to conveniently monitor the replenishment needs of the textile winding machine. Briefly described, the present invention provides, in one aspect hereof, a textile winding machine having a plurality of winding units arranged in side by side manner along a longitudinal extent of the textile winding machine each for unwinding yarn from a feed package onto a winding package, each feed package including a body of textile strand material built on a tube. The textile winding machine also includes a plurality of tube support members each for individually supporting a tube thereon in a generally fixed disposition relative to the tube support member, and a delivery transport assembly for delivering tube support members to the winding units for unwinding of yarn from feed packages supported on the tube support members.

The delivery transport assembly includes means forming a common entrance path and a plurality of through path means each forming a through-path through a respective one of the winding units for transporting tube support members from the common entrance path through the respective winding unit from which tube support members are discharged from the winding units each through-path having an upstream end adjacent the common entrance path and a downstream end. The textile winding machine also includes an exit transport assembly for transporting tube support members from the downstream ends of the through-path including at least one longitudinally extending exit path extending adjacent the downstream end of at least one through-path, each tube support member being transported from a winding unit supporting a selected one of an empty tube, a partially unwound feed package and a full feed package. The through paths, the delivery transport assembly and the exit transport assembly are all located in substantially the same horizontal plane.

The textile winding machines of the one aspect of the present invention also includes a feed package re-supply support assembly connected to the delivery transport assembly and the exit transport assembly, the feed package re-supply support assembly having a longitudinally extending operator level support means for supporting tube support members at a predetermined height above the horizontal plane, the predetermined height being selected to provide an operator with ready access to the tube support members supported on the operator level support means during manual tube and feed package handling operations performed by the operator. The at least one exit path and the operator level support means are at least partially longitudinally coextensive.

According to an additional feature of the one aspect of the present invention, the feed package re-supply support assembly preferably further includes an entry conveyor means for conveying tube support members from the exit transport assembly to the feed package re-supply support assembly, the entry conveyor means conveying the tube support members in spaced apart manner so as to maintain the respective tubes and feed packages supported on the tube support members out of contact with one another, and a return conveyor means for conveying tube support members from the feed package re-supply support assembly to the delivery transport assembly.

In the one aspect of the present invention, the operator level support means includes a longitudinal portion extending adjacent the winding units on one longitudinal side of the textile winding machine. Also, the at least one exit path includes a portion extending adjacent the winding units on the one longitudinal side of the textile winding machine and below the longitudinal portion of the operator level support means.

According to further features of the one aspect of the present invention, the textile winding machine also includes a tube removing device disposed adjacent a selected one of the exit transport assembly and the feed package re-supply support assembly for selectively removing tubes from tube support members transported therepast. Additionally, the textile winding machine includes a sensor for distinguishing between a tube having less than a predetermined amount of yarn thereon and a tube having at least a predetermined amount of yarn thereon and the tube removing device being operable to remove a tube in response to sensing by the sensor of the tube.

In the one aspect of the present invention, the operator level support means preferably includes an endless belt extending generally horizontally and having a top run positioned for supporting the tube support members at the predetermined height and drive means for driving operation of the endless belt. Also, the entry conveyor means preferably includes a vertical transport component having an endless member and a plurality of carrier members mounted to the endless member at generally uniform spacings therealong, and means for driving the endless member in a vertical plane, each carrier member for supporting a tube support member during transport of the tube support member by the endless member. According to this feature, each tube support member includes an annular ring portion, a peg support portion concentric with the annular ring portion, and a plurality of spoke members fixedly interconnecting the annular ring portion to the peg support portion, with each adjacent pair of the spoke members, the annular ring portion, and the peg support portion forming an engagement opening for the insertion therein of a carrier member for support of the tube support member by the carrier member.

According to an additional feature of the one aspect of the present invention, the tube removing device includes an arm selectively movable between a clearance position out of interference with the tubes traveling past the tube removing device and a tube removing position in which the arm is at an angle to the travel path of the tubes, the arm operating to engage a tube traveling therepast to block further travel of the tube while the respective tube support member supporting the tube continues to be transported past the arm by the vertical transport component, whereby the engaged tube is dislodged from its fixed disposition on the respective tube support member.

According to a different feature of the one aspect of the present invention, the tube removing device includes a pair of rollers each having a roller axis and means for supporting each roller at a tube removing location adjacent the travel path of the tube support members being transported by the vertical transport component with the roller axis of each roller being aligned generally parallel to the direction of travel of the tube support members at the tube removing location. The pair of rollers are arranged generally parallel to one another and form a roller gap therebetween. The tube removing device also includes means for selectively varying the roller gap from a tube engaging spacing at which each roller engages a tube traveling between the rollers to effect removal of the tube and a clearance spacing at which the roller gap is sufficient to permit travel of a tube between the pair of rollers without engagement thereby, and means for driving each roller about its roller axis.

In another aspect of the present invention, the textile winding machine includes an auxiliary handling assembly connected to the exit transport assembly and the delivery transport assembly, the auxiliary handling assembly having an empty tube transfer device for transferring empty tubes supported on tube support members and a feed package transfer device for disposing feed packages onto empty tube support members, and means for selectively guiding the tube support members being transported by the exit transport assembly to a selected one of the entry conveyor means and the auxiliary handling assembly.

According to yet another aspect of the present invention, the operator level support means includes a generally horizontally extending endless belt and further comprising synchronous driving means, connected to the endless members of the vertical transport components of the entry conveyor means and the exit conveyor means and to the endless belt of the operator level support means for synchronously driving the endless members.

According to yet a further feature of the one aspect of the present invention, the means forming a common entrance path includes an endless belt and means for selectively reversing the direction of travel of the endless belt, and stop means including a pair of spaced apart stop arms for limiting the travel of the tube support members supported on the endless belt to the extent of the endless belt between the stop arms. Also, the feed package re-supply support assembly includes a generally horizontal endless belt, means for driving the endless belt to effect transport of the tube support members from the entry conveyor means to the return conveyor means, and stop means for selectively preventing the travel of tube support members past a stop location intermediate the entry conveyor means and the return conveyor means. The stop means preferably includes an arm and a sensor for distinguishing between a tube supported on a tube support member having less than a predetermined amount of yarn and a tube supported on a tube support member having at least the predetermined amount of yarn, and means for selectively positioning the arm in the travel path of the tube support members on the endless belt to prevent the travel therepast of the tube support members, the means for selectively positioning the arm being responsive to the sensing by the sensor of a tube having less than the predetermined amount of yarn to extend the arm in the travel path of the tube support members.

DETAILED DESCRIPTION OF THE PREFERRED EMBODIMENTS

Figure 1:
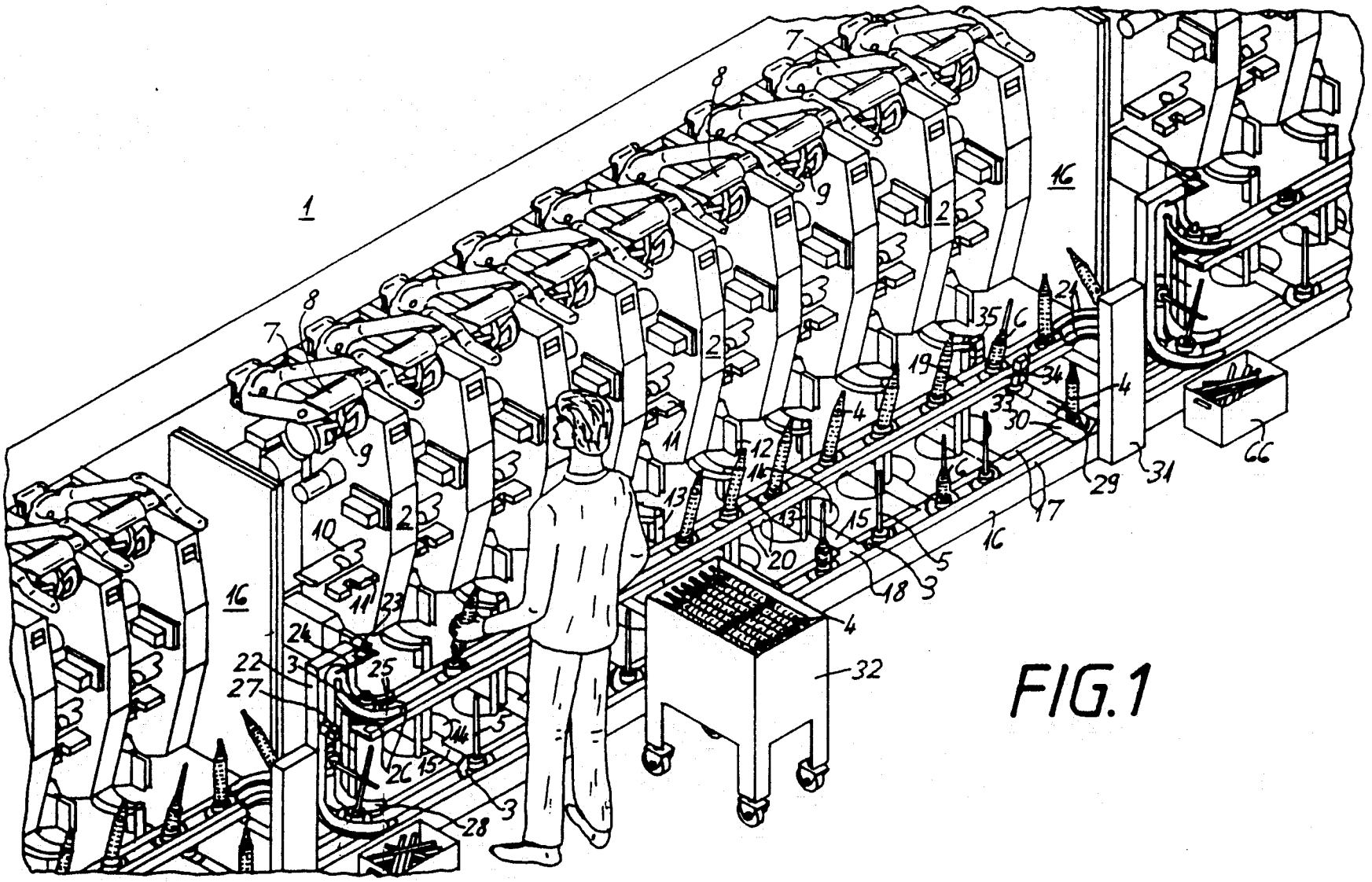
FIG. 1 is a perspective view of one embodiment of a textile winding machine of the present invention showing a feed package supply access side of the machine on which an operator can conveniently access the tubes support members which individually support tubes and yarn packages for performing tube and yarn package exchange operations thereon.
Figure 2:
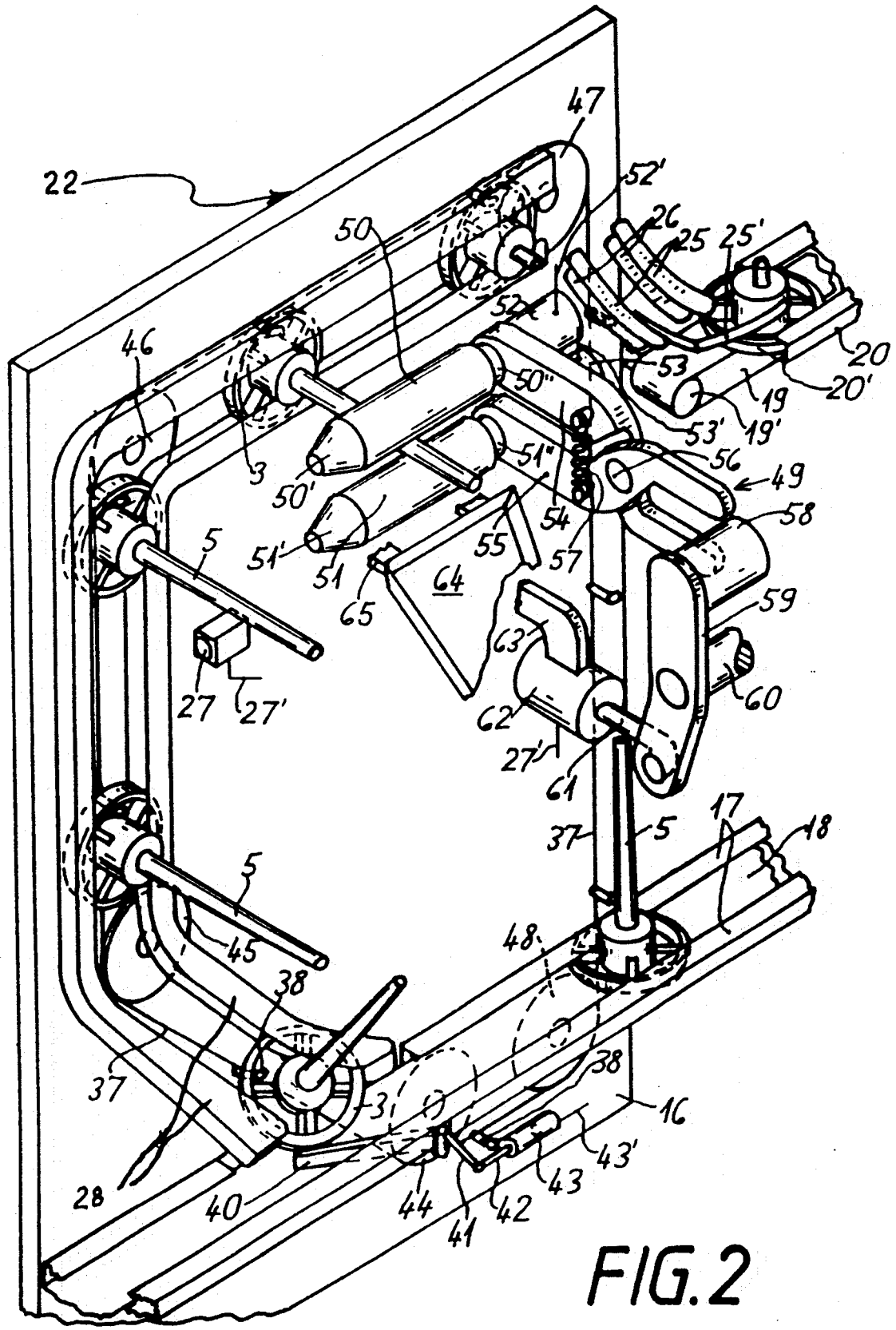
FIG. 2 is an enlarged perspective view of one variation of an entry conveyor means of the textile machine shown in FIG. 1 for conveying tube support members exiting the winding units of the textile winding machine to a support element on which the tube support members are supported for ready access thereto by an operator.
Figure 3:
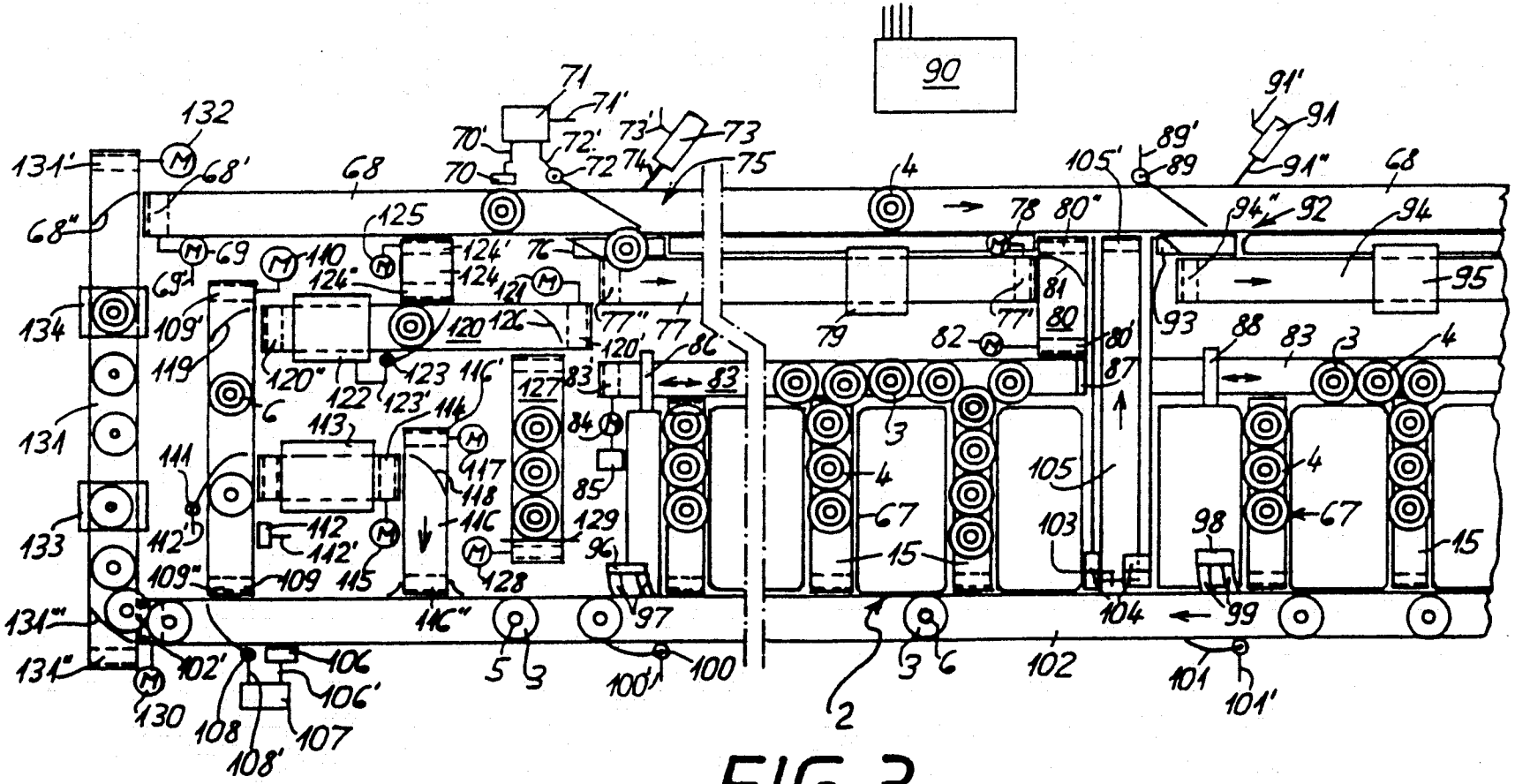
FIG. 3 is a schematic top plan view of a system incorporating the textile winding machine of the present invention.
Figure 4:
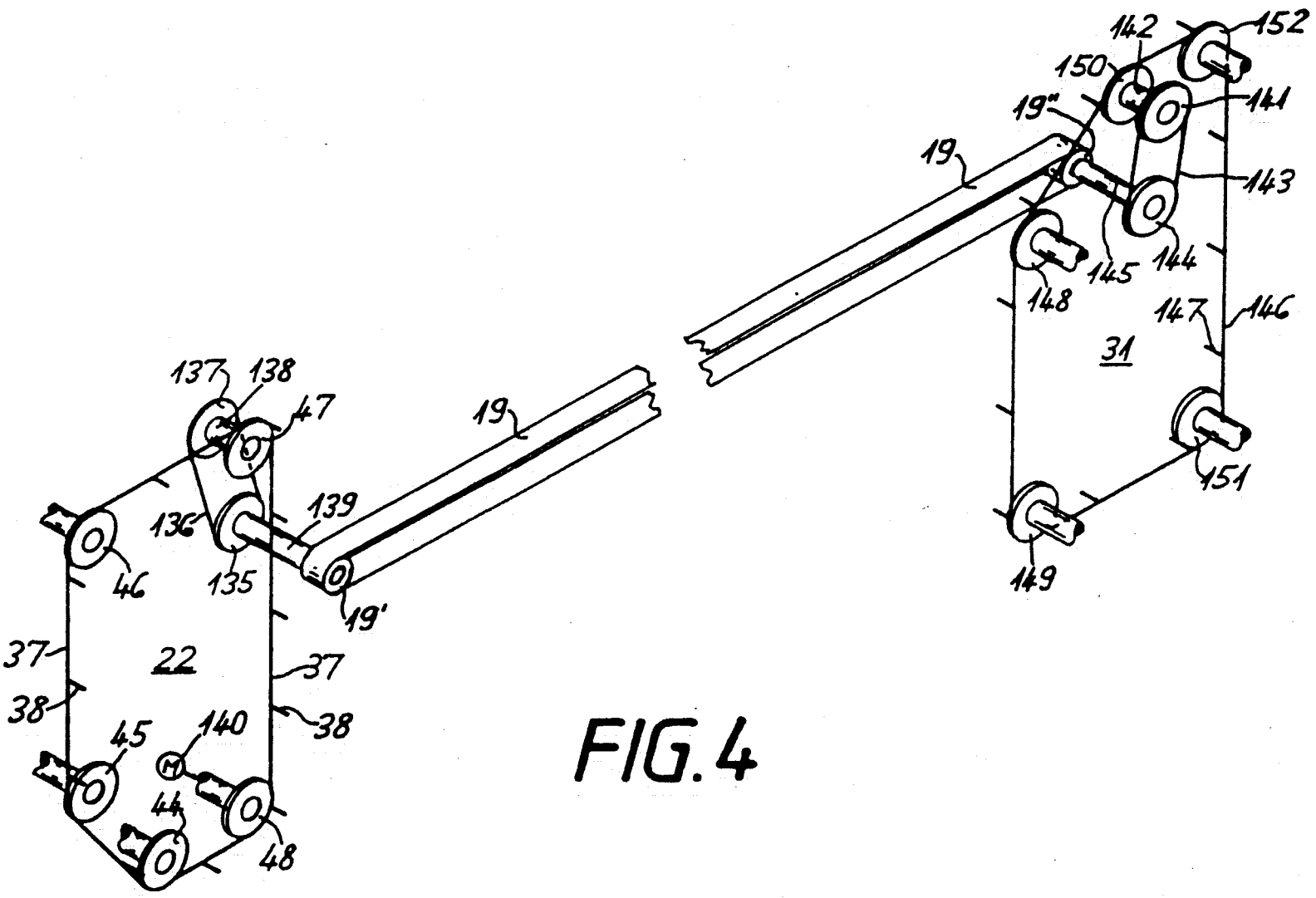
FIG. 4 is an enlarged perspective cutaway view of a synchronous conveyor drive assembly of the textile winding machine shown in FIG. 1.

FIGS. 1 and 2 illustrate one embodiment of the textile winding machine 1 of the present invention, FIG. 3 illustrates a system incorporating the embodiment shown in FIGS. 1 and 2, and FIG. 4 illustrates one variation of an aspect of the embodiment shown in FIGS. 1 and 2. The textile winding machine 1 includes a plurality of winding units 2 arranged in side by side manner along the longitudinal extent of the textile winding machine each for individually unwinding yarn from a feed package 4 onto a winding package 8 which is rotatably supported on a frame member 7 for winding rotation by a winding drum 9. The yarn being unwound from a feed package 4 at a winding unit 2 travels through several conventional yarn handling elements such as, for example, an electronic yarn cleaner 10 enroute to the winding package 8. Each winding unit 2 additionally includes a yarn splicing device 11 for effecting splicing of two yarn ends together in the event of, for example, a yarn break or in correspondence with a feed package supply operation in which a new feed package is supplied to the winding unit for winding thereat.

Each feed package 4 comprises yarn built on a tube 5 and the tube 5 of each feed package 4 is removably fixedly mounted to a tube support member 3 for individual support of the feed package 4 during its transport to, at, and from one of the winding units 2 for winding of the feed package 4 thereat. In the event that the yarn of a feed package 4 is not fully drawn off of the tube 5 during a winding operation at a winding unit 2', a partially wound feed package 6' remains and these partial feed packages 6 are released from the winding units 2 for further handling as described in more detail below.

Each tube support member 3 includes, as best seen in FIG. 2, an outer member or annular ring, a peg support portion, and a plurality of spokes, each spoke being positioned generally at a right angle from the adjacent spokes and each spoke for fixedly interconnecting the peg support portion to the annular ring with the peg support portion being concentric with the annular ring. The peg support portion includes a peg compatibly configured with the inner diameter of the tube 5 for snugly receiving the tube 5 inserted thereon to effect support of the tube in a fixed disposition relative to the tube support member 3 throughout horizontal and vertical transport of the tube support member.

The textile winding machine 1 includes a delivery transport assembly for delivering the tube support members 3 with the feed packages 4 supported thereon to the winding units 2 for individual winding of the feed packages 4 thereat. The delivery transport assembly includes a means 68 forming a common entrance path and a plurality of through-path means, each through-path means forming a through-path 15 through a respective winding unit 2 for transporting the tube support members 3 from the entrance path to the winding location of each winding unit 2. Additionally, the through-paths 15 transport the tube support members 3 from the winding locations of the winding units 2 to a common exit path 18 formed by an exit transport assembly after winding of the feed package 4, or after an attempt to wind the feed package 4, at the winding unit 2. The common entrance path, the through paths 15, and the common exit path 18 are all generally disposed in the same horizontal plane which is slightly elevated above the floor on which the textile winding machine 1 is disposed.

The common entrance path means 68 includes an endless belt 75 trained around a conventional guide roller (not shown) and a drive roller 68', which is operatively connected to a drive motor 69 for driving operation of the belt 75. The delivery transport assembly and the exit transport assembly are operatively interconnected to one another by a feed package re-supply support assembly operable to support the tube support members 3 at a location for convenient access thereto by an operator while executing one of a number of manual operations associated with the re-supplying of the feed packages 4 to the textile winding machine 1. The feed package re-supply support assembly includes an operator level support means for supporting the tube support members discharged from the winding units 2 at a predetermined height vertically spaced from the floor on which the textile winding machine is disposed, the predetermined height being selected in consideration of ergonomic factors relating to the ease and comfort of an operator in accessing the tubes 5, partial feed packages 6, and feed packages 4 supported on the tube support members 3 during exchange operations therewith. An entry conveyor means 22 conveys the tube support member from the common exit path 18 to the operator level support means and is operable to raise the tube support members 3 exiting one end of the common exit path 18 to one end of the operator level support means.

A return conveyor means 31 conveys the tube support members 3 from the operator level support means to the delivery transport assembly and is operable to lower the tube support members 3 from another end of the operator level support means to the common entrance path.

Each winding unit 2 includes a yarn end loosening chamber means 13 of the type such as disclosed, for example, in U.S. patent application Ser. No. 457,101, filed Dec. 26, 1989, now U.S. Pat. No. 5,056,726 which is incorporated by reference herein, for retaining a tube support member 3 supporting a partial feed package 6 or a feed package 4 at the winding location of the winding unit during the loosening of a yarn end thereof as well as during the winding of yarn from the feed package by the winding unit 2. The yarn end loosening chamber means 13 includes a pair of chamber portions, each being selectively movable between a disengaged position in which the chamber portion is disposed in a recess 14 on the side of the through-path 15 out of clearance with the tube support members being transported along the respective through-path 15 passing through the winding unit and a chamber forming position in which the chamber portion cooperates with the other chamber portion to form a yarn end loosening chamber surrounding the partial feed package 6 or the feed package 4 disposed therein in which streams of air are tangentially directed against the feed package to effect the loosening of a yarn end therefrom. Each winding unit 2 includes a conventional suction device 12 for cooperating with the yarn end loosening chamber means 13 to engage a yarn end loosened from a feed package disposed within the chamber portions for subsequent feeding of the engaged yarn end to the splicing device 11 for splicing with a yarn end extending from the winding package 8.

Each through-path 15 can be formed, for example, by a pair of guide plates having opposed surfaces spaced apart from one another at a spacing sufficient to permit the travel therebetween of the peg support portion of a tube support member 3 yet at a spacing less than the diameter of the annular ring portion of a tube support member 3, and an endless conveyor belt having its top run in alignment with the gap between the opposed surfaces of the pair of guide plates. The top run of the endless conveyor belt is disposed lower than the pair of guide plates for permitting the annular ring portion of a tube support member to pass at a clearance below the pair of guide plates as the peg support portion of the tube support member travels between the opposed surfaces of the guide plates. Each guide plate of the pair of guide plates associated with each winding unit 2 includes one of the semicylindrically shaped recess 14.

The common exit path means 18 is formed by a pair of guide plates 17 having opposed surfaces at a spacing from one another sufficient to permit travel therebetween of a peg support portion of a tube support member and an endless conveyor belt extending transversely to, and adjacent the downstream end of, each through-path 15. In this arrangement, the tube support members 3 transported along the through-path 15 by the endless conveyor belt forming the through-path are automatically transferred to the endless conveyor belt of the common exit path means 18 for further transfer of the tube support member 3 in a direction generally parallel to the longitudinal extent of the textile winding machine 1.

The entry conveyor means 22 is disposed at one end of the common exit path means 18 and includes, as seen in FIG. 1, a pair of guide plates 28 mounted to the frame of the textile winding machine 1 and a pair of release guide plates 26 for guiding the tube support members 3 as they exit the entry conveyor means 22 onto the operator level support means. The entry conveyor means 22 also includes a vertical transport component which, as best seen in FIG. 2, includes a carrier member conveying means in the form of an endless member or belt 37 trained around a plurality of guide rollers 44, 45, 46, and 47 and a drive roller 48 and traveling in an endless loop through an upward run, a top run, a downward run and a lower run. The drive roller 48 is operatively interconnected to a drive motor 140 for driving movement of the belt 37 in an endless loop disposed in a vertical travel plane. The belt 37 includes a plurality of carrier members 38 mounted to the belt at uniform spacings therealong, each carrier member 38 for individually carrying a tube support member 3 for transport of the tube support member by the belt 37 between an entry location at which the tube support member passes from the common exit path means 18 to the guide channel formed between the pair of guide channel members 28 and a release location at which the tube support member is released from the belt 37 by the release guide plates 26.

The pair of guide channel members 28 each form a generally C-shaped channel operable to receive a portion of the annular ring portion of each tube support member 3 as the peg support portion of the tube support member is guided between the pair of the guide members 28. The lower end of the guide members 28 are formed in a generally arcuate shape for guiding each tube support member 3 exiting the common exit path 18 through an upward arcuate path to a location at which a respective one of the carrier members 38 engages the tube support member for transport of the tube support member by the vertical transport component. Each guide channel member 28 includes a rear surface portion for sliding engagement of the bottom surface of the tube support members 3 therealong during guiding engagement thereof by the guide channel members 28. Each adjacent pair of the spokes of each tube support member 3, its annular ring, and its peg support portion form an opening for receiving therein one of the carrier members 38 to effect engagement of the tube support member by the carrier member 38.

The endless conveyor belt of the common exit path 18 advances each tube support member 3 into the guide channel means with the peg support portion of the tube support member disposed between the pair of guide channel members 28 and the endless conveyor belt advances the tube support member sufficiently along the guide channel to position the tube support member for engagement by the next on-coming carrier member 38. After the next on-coming carrier member 38 has engaged the tube support member, it conveys the tube support member with diametrically opposed portions of the annular ring of the tube support member each being guided by a respective one of the guide channel members 28 as the carrier member 38 is moved upwardly. As the carrier member 38 begins its downward run, the release guide plates 26 engage the tube support member to effect release of the tube support member from the carrier member 38 and the released tube support member slides between the pair of release guide plates 26, which reorient the tube support member from a vertical disposition to a horizontal disposition.

The operator level support means includes a guide channel member 20 having a pair of opposed, spaced apart parallel surfaces between which the peg support portion of each tube support member is guided. As seen in FIG. 4, an endless belt 19 is trained around a pair of guide rollers 19', 19'' and has a top run extending along the extent of the guide channel member 20 for transporting tube support members transferred thereto by the release guide plates 26 in a direction parallel to the longitudinal extent of the textile winding machine 1 in a direction from the entry conveyor means 22 toward the return conveyor means 31. The operator level support means supports the tube support members at a height above the common exit path 18, preferably at the height of the waist level of an average operator, at which the operator can easily reach to and grasp the tubes 5, partial feed packages 6 and feed packages 4 supported on the tube support members during the execution of an exchange operation in which, for example, the respective tube or feed package supported on the tube support member is replaced by a fresh feed package 4.

The return conveyor means 31 is configured substantially similar to the entry conveyor means 22 except that the return conveyor means 31 includes a pair of spaced apart guide channel members 21 for guiding the tube support members exiting the operator level support means to an engagement position at which the tube support members are engaged by a vertical transport component for lowering of the tube support members. The vertical transport component of the return conveyor means 31 includes a carrier member conveyor means in the form of an endless member or belt 146 trained around a plurality of guide rollers 148, 149, 151, and 152 and a drive roller 150.

As seen in FIG. 4, a synchronous drive arrangement can be provided for synchronous driving of the vertical transport components of the discharge and return conveyor means and the feed package re-supply support assembly. As seen in FIG. 4, the drive roller 150 is mounted to one end of a shaft 142 having a roller 141 fixedly mounted to its other end. A drive belt 143 is trained around the roller 141 and another roller 144 which is fixedly mounted to one end of a shaft 145. The guide roller 19'' about which the belt 19 is trained is fixedly mounted to the other end of the shaft 145. The other guide roller 19', adjacent the entry conveyor means 22, is fixedly mounted to one end of a shaft 139 and a roller 135 is fixedly mounted to the other end of the shaft 139. A drive belt 136 is trained around the roller 135 and another roller 137 which is fixedly mounted to one end of a shaft 138. The guide roller 47 associated with the belt 37 is fixedly mounted to the other end of the shaft 138. Through the arrangement of the various rollers 141, 144, 135, and 137, the drive belts 136, 143, and the guide rollers 19', 19'', and the belt 19, the belts 37, 146 of the vertical transport components associated with the entry conveyor means 22 and the return conveyor means 31 are driven in synchronization with one another and, additionally, in synchronization with the movement of the belt 19 as it transports the tube support members along the operator level support means.

A pair of release guide plates 30, only one of which is shown, operates similarly to the pair of release guide plates 26 for effecting release of the tube support members 3 from the carrier members 147 onto a return belt 29.

The guide channel members 21 change the orientation of the tube support members 3 exiting the operator level support means from a horizontal orientation to an inclined orientation in position for engagement by the next on-coming one of a plurality of carrier members 147 mounted to the belt 146 at uniform spacings thereafalong. The next on-coming carrier member 147 engages the tube support member supported in the incline position and supports the tube support member for transport by the belt 147 to a lower position at which a pair of release guide plates (not shown) similarly configured to the release guide plates 26 effect release of the tube support member 3 from the carrier member 147 onto an endless belt 29, shown in FIG. 1. The endless belt 29 extends from its upstream end adjacent the return conveyor means 31 to a location adjacent the common entrance path for transporting the tube support members to the delivery transport assembly for subsequent transport to the winding units 2.

With further reference to the operator level support means, the belt 19 is preferably inclined in the direction of movement of the tube support members 3 during transport through the through-path 15. Due to this slight inclination, the partial feed packages 6 supported on the tube support members 3 tilt slightly outwardly relative the textile winding machine 1 for facilitating grasping thereof by an operator performing an exchange operation.

The delivery transport assembly, the exit transport assembly, the entry conveyor means 22, the operator level support means, and the return conveyor means 31 together comprise a closed loop transport system for transporting the tube support members 3 to and from the winding units 2 and to and from a re-supply location at which an operator can readily access the tubes or feed packages supported on the tube support members in an exchange operation. For example, as seen in FIG. 2, an operator can individually transfer fresh feed packages 4 supported in a rolling cart 32 to those tube support members 3 supported on the operator level support means which are not supporting a tube or feed package. Since the operator level support means supports the tube support members 3 generally at the level of the waist of the operator, the range of movement of the operator in transferring the fresh feed packages 4 from the rolling cart 32 to the tube support members 3 does not require the operator to bend his or her legs, thus providing an ergonomically optimum posture for the operator during the exchange operation.

With regard now to further features of the textile winding machine 1 which contribute toward the flexibility and capability of the closed loop transport system, the entry conveyor means 22 is preferably provided with an empty tube takeoff component comprising a sensor 27 positioned adjacent the travel path of the tube support members 3 as they are transported in the upward run of the belt 37 and a hydraulic cylinder 23 having a liftoff arm 24. The hydraulic cylinder 23 is operatively connected to the sensor 27 via a conventional connector (not shown) and the hydraulic cylinder 23 and arm 24 are operable to remove a tube in response to the receipt of the signal from the detector 27 indicating that the detector 27 has detected the travel therepast of a tube support member 3 supporting the tube having no remaining yarn thereon or a remaining amount of yarn insufficient for recirculation of the feed package to the winding units (collectively referred to as the empty tubes 5). The liftoff arm 24 has one end pivotally connected to the free end of the shaft of the hydraulic cylinder 23 and is pivotally connected generally at its midsection to a post mounted to the entry conveyor means 22 and extending outwardly therefrom. In response to a signal from the detector 27 indicating the detection of an empty tube 5, the hydraulic cylinder 23 moves the liftoff arm 24 from its disengaged position to its tube liftoff position. In its disengaged position, the liftoff arm 24 is disposed transversely relative to the travel path of the tube support members 3 as they are transported in the downward run of the belt 37 and outwardly relative to the travel path such that the empty tubes 5 o feed packages supported on the tube support members 3 travel therepast without engagement by the liftoff arm 24. The hydraulic cylinder 23 moves the liftoff arm inwardly toward the travel path in response to the signal from the detector 27. Upon retraction by the hydraulic cylinder 23 of its shaft, the free end of the liftoff arm 24 pivots outwardly to the liftoff position in which it extends transversely across the travel path of the empty tube 5 as the respective tube support member 3 on which the empty tube is supported slides downwardly between the release guide channels 26. The respective empty tube 5 contacts the liftoff arm 24 while the respective tube support member 3 supporting the tube is transported downwardly by the belt 37 and this action effects dislodgement of the empty tube 5 from the tube support member. A suitable container such as, for example, the box 66 shown in FIG. 1, can be disposed adjacent the entry conveyor means 22 for the collection of the empty tubes 5 lifted off of the tube support members 3 by the liftoff arm 24.

If the detector 27 detects that the respective tube support member 3 traveling therepast is supporting a partial feed package 6 or a feed package 4, the hydraulic cylinder 23 is not actuated to pivot the liftoff arm 24 and therefore continues to maintain the liftoff arm 24 in its disengaged position. Accordingly, those tube support members 3 supporting partial feed packages 6 or feed packages 4 continue to support the feed packages as they exit the entry conveyor means 22 onto the belt 19 of the operator level support means while those tube support members 3 supporting empty tubes 5 have the empty tubes lifted thereoff and exit onto the belt 19 as empty tube support members.

A detecting component 35 is disposed adjacent the downstream end of the belt 19 and includes a lower sensor for sensing the travel therepast of a tube support member and an upper sensor for sensing the presence or absence of a tube or feed package on the sensed tube support member and, if the upper sensor senses the presence of a feed package, the upper sensor is operable to distinguish between the partial feed packages 6 and the feed packages 4. An electromagnet stop component 33 having a stop arm 34 is disposed downstream of the sensor component 35 relative to the direction of travel of the belt 19 and is operatively connected to the sensing component. In response to the sensing by the lower sensor of the sensing component 35 of a tube support member traveling therepast in conjunction with the sensing by the upper sensor of the presence of a partial feed bobbin 6, the electromagnetic stop component 33 moves its stopper arm 34 from a disengaged position out of clearance with the travel path of the belt 19 to a stop position transverse to the direction of travel of the tube support members along the travel path of the belt 19 to thereby stop further travel of the tube support member 3 therepast.

The tube support members 3 following the respective stopped tube support member 3 supporting a partial feed package 6 are eventually moved into abutting contact with one another due to the continuing movement of the belt 19 while the frontmost tube support member 3 supporting the sensed partial feed package 6 abuts the stop arm 34, thereby creating a backup of the tube support members 3 along the extent of the belt 19. Accordingly, when the operator monitors the status of the winding operations at the textile machine 1 during, for example, a regularly scheduled monitoring inspection, the operator is presented with a plurality of the tube support members 3 supported on the operator level support means. Some of the tube support members 3 may be empty, thereby requiring the re-supply of the feed package 4, while other tube support members 3 may support a partial feed package 6.

As it can be assumed that each partial feed package 6 was discharged from one of the winding units 2 before complete winding of the yarn on the package due to the inability of the winding unit to find a yarn end on the package, the operator can, in addition to re-supplying the empty tube support members 3 with feed packages 4, manually locate and dispose a yarn end of each partial feed package 6 in a preferred disposition on the feed package for ready engagement of the yarn end by a winding unit 2 during subsequent feeding of the partial feed package 6 to the winding units. Accordingly, after the operator has caused the stop arm 34 to be returned to its disengaged position (such as, for example, through the actuation of a button (not shown) which causes the electromagnetic stop component 33 to move the stop arm 34 from its stop position to its disengage position), each tube support member 3 exiting the belt 19 onto the return conveyor means 31 supports either a fresh feed package 4 or a partial feed package 6 having its yarn end disposed in a preferred disposition.

In FIG. 2, one variation of the empty tube removal device positioned at the entry conveyor means 22 is illustrated. In lieu of the hydraulic cylinder 23 and the liftoff arm 24, the variation illustrated in FIG. 2 includes an empty tube removal device 49 having a pair of rollers 50, 51 having a conically tapering free end 50', 51', respectively, and being fixedly mounted on a shaft 50'', 51'', respectively. The shaft 50'', 51'' is rotatably supported in an arm 54, 55, respectively, of a scissor-type roller actuating device and the arms 54, 55 are pivotally connected to one another by a pivot 56. A spring 57 connected at one end to the arm 54 and at its other end to the arm 55 normally biases the arms in a closed position in which the arms are pivoted toward one another. A roller drive motor 52, 53 is mounted to the free end of the arm 54, 55, respectively, and is operatively connected to the shaft 50'', 51'', respectively, for driving rotation of the roller 50, 51, respectively. The roller drive motor 52, 53 is connected via a lead 52', 53', respectively.

The roller 50, 51 extends parallel to the travel path of the tube support members 3 being transported by the belt 37 along an upper horizontal run of the belt and is spaced outwardly relative to the vertical plane in which the belt 37 moves for engagement of an empty tube 5 traveling therepast. The conically tapering end 50', 51', of the roller 50, 51, respectively, is disposed for initially engaging an empty tube 5 transported into engagement with the roller. The spacing between the rollers 50, 51 is selected in correspondence with the diameter of an empty tube 5 so that an empty tube 5 passing between the rollers 50, 51 in the closed position of the arms 54, 55 is engaged by both rollers.

The free ends of the scissor arms 54, 55 form therebetween a gap. A scissor actuator linkage 59 includes an arm having a gap roller 58 pivotally mounted to one end thereof. The arm of the scissor actuator member 59 is pivotally mounted by a shaft 60 to the frame of the textile winding machine 1. The other free end of the arm of the scissor actuator member 59 is movably connected to the free end of a rod 61 of a hydraulic cylinder assembly 62 which is mounted via a bracket 63 to the frame of the textile winding machine 1. The cylinder of the hydraulic piston and cylinder assembly 62 is connected via a lead 27' to the sensor 27. The retraction of the piston 61 into the cylinder of the cylinder and piston assembly 62 effects pivoting of the gap roller 58 out of engagement with the free end of the scissor arms 54, 55. When the piston 61 is extended from the cylinder of the cylinder and piston assembly 62, the gap roller 58 is pivoted in correspondence with the extension of the piston 61 into the gap between the free end of the scissor arms 54, 55 to thereby effect pivoting of the scissor arms 54, 55 away from one another against the bias of the spring 57 and this pivoting movement of the scissor arms 54, 55 effects a corresponding widening of the gap between the rollers 50, 51.

The rollers 50, 51 are normally maintained in a spaced apart condition due to the disposition of the gap roller 58 between the free ends of the scissor arms 54, 55 and the spacing between the rollers 50, 51 in their normal positions is sufficiently greater than the maximum diameter of a partial feed package 6 or a feed package 4 being transported by the entry conveyor means 22 to permit passage of the feed package between the rollers 50, 51 at a clearance from each roller. In this manner, the partial feed packages 6 and the feed packages 4 arrive at the operator level support means in readiness for manual yarn end preparation (in the case of a partial feed package 6) and/or subsequent transport to the winding units 2 for winding of the feed packages thereat.

An appropriate stop component (not shown) can be provided in the space between the scissor arms 54, 55 for preventing the scissor arms from pivoting toward one another beyond a predetermined amount. This alleviates the need for each oncoming empty tube 5 entering between the rollers 50, 51 to forcibly separate the rollers as it travels therebetween from an initial position in which the rollers 50, 51 are in contact with one another, as would be the case if the scissor arms 54, 55 were permitted to pivot fully toward one another.

The empty tube removal device 49 operates as follows to effect the removal of the empty tubes 5 detected by the sensor 27. In response to a signal received via the connector 27' from the sensor 27 indicating the travel therepast of an empty tube 5, the cylinder of the cylinder and piston assembly 62 retracts the piston 61 to effect movement of the gap roller 58 out of its normal position between the free ends of the scissor arms 54, 55 to its outward position outwardly of the gap between the free ends of the scissor arms, whereupon the biasing action of the spring 57 effects pivoting of the scissor arms 54, 55 about the pivot 56 toward one another. This pivoting movement of the scissor arms 54, 55 decreases the gap between the rollers 50, 51 to an extent that the rollers are positioned for engaging the oncoming empty tube 5. The conically tapering ends 50', 51' of the rollers 50, 51, respectively, facilitate the entrance of the empty tube 5 into the gap between the rollers. The roller drive motors 52, 53 rotate the rollers 50, 51, respectively, in mutually opposite directions. If desired, the operation of the roller drive motors 52, 53 can be responsive to the sensing of the sensor 27 of an empty tube so that the rollers 50, 51 are rotated only upon the sensing of an empty tube 5.

To ensure that the empty tubes 5 removed from the tube support members 3 are reliably received in the container 66, a chute 64 mounted by a bracket 65 to the textile winding machine 1 is provided. The chute 64 is so positioned that each empty tube 5 extracted by the rollers 50, 51 falls onto the chute immediately after exiting the rollers and is thereafter guided directly to the container 66.

FIG. 2 additionally shows one configuration of the release guide plates 26 for effecting the release of the tube support members 3 from their respective associated carrier members 38 on the belt 37. In this configuration, each release guide plate 26 includes top and bottom guide surfaces 25, with each respective pair of top and bottom guide surfaces 25 being spaced apart from one another sufficiently to permit passage therebetween of the annular ring portion of a tube support member 3. The top and bottom guide surfaces 25 of each release guide plate 26 are arcuately shaped and are mounted to the textile winding machine 1 at a downward inclination in a direction transversely outwardly relative to the longitudinal extent of the textile winding machine. Additionally, the entry conveyor means 22 includes a guide profile 25' positioned for cooperating with the release guide plates 26 to guide the tube support members 3 released from the belt 37 onto the belt 19 of the operator level support means.

It has also been found that the transfer of the tube support members 3 from the release guide plates 26 onto the belt 19 can be facilitated if the guide roller 19' is disposed with its axis horizontally oriented. Additionally, the transfer operation will also be enhanced if the guide channel member 20, which cooperates with the belt 19 in guiding the tube support members 3 along the operator level support means, is inclined relative to the horizontal in the direction transversely outwardly from the textile winding machine 1 relative to its longitudinal extent. Likewise, it has been found that the transfer operation by which the tube support members 3 are transferred from the belt 19 to the return conveyor means 31 can be facilitated if the other guide roller 19'' is disposed with its axis in a horizontal plane.

The variation of the present invention illustrated in FIG. 3 relates to a system for operatively interconnecting several textile winding machines in a manner in which the several textile winding machines can be continuously supplied with feed packages which have been re-supplied and/or manually handled by an operator as the tube support members 3 are supported on an operator level support means in accordance with the present invention. In connection with the following description of the variation of the present invention illustrated in FIG. 3, reference is made to U.S. patent application Ser. No. 537,363, filed June 13, 1990, now U.S. Pat. No. 5,056,725, which is incorporated by reference herein.

As seen in FIG. 3, the system includes a first textile winding machine configured similarly to the textile winding machine 1 illustrated in FIG. 1 and including a plurality of winding units each having a through-path 15 extending therethrough for the transport of the tube support members 3 supporting feed packages 4 to and from the winding units. For the sake of convenient illustration, only two of the through-paths 15 of the first textile winding machine are illustrated in FIG. 3 and these two throughpaths 15 can be seen to the left hand side of a return path 105. The return belt 105 is trained around a conventional drive roller (not shown) which is operatively connected to a conventional drive motor (not shown), and a guide roller 105'. The system also includes a second textile winding machine aligned in a longitudinal direction with the first textile winding machine and only the first two through-paths 15 of the second textile winding machine (on the right hand side of the return path 105) are shown in FIG. 3 for the sake of convenient illustration. The system illustrated in FIG. 3 additionally includes, as seen on the left hand side of the double broken lines in FIG. 3, a plurality of tube handling components and feed package handling components (referred to hereinafter as auxiliary handling components) which will be described in greater detail below.

The first and second textile winding machines each include an entry conveyor means, an operator level support means, and a return conveyor means configured the same as the like components of the embodiment shown in FIG. 1. Accordingly, for clarity of illustration, only the pair of guide channels 97 of an entry conveyor means 96 and a pair of release guide plates 104 of a first return conveyor means 103 associated with the first textile winding machine and a pair of guide channels 99 of a second entry conveyor means 98 associated with the second textile winding machine are illustrated, it being understood that the other components of the first entry conveyor means 96, the first return conveyor means 103 and the second entry conveyor means 98, as well as the operator level support means of each of the first and second textile winding machines and a return conveyor means associated with the second textile winding machine are also comprised in the system illustrated in FIG. 3.

The system illustrated in FIG. 3 includes a common delivery path means 68 for transporting the tube support members 3 along the entire extent of the first and second textile winding machines on the same respective side thereof, as well as along one side of the additional components on the left hand end of the system. Additionally, the system includes a common discharge path mean 102 extending along the entire extent of the first and second textile winding machines on the same opposite respective side thereof, and along the respective opposite side of the auxiliary handling components on the left hand end of the system. The common delivery path means 68 and the common exit path means 102 transport the tube support members 3 being delivered to, or being discharged from, the first and second textile winding machines along their respective delivery and exit paths.

In contrast to the embodiment illustrated in FIG. 1, the system shown in FIG. 3 is provided with the capability to selectively guide the tube support members 3 onto an entry conveyor means or, alternatively, to permit the exit path means 102 to further transport the tube support members 3 exiting the winding units to the auxiliary handling components at the left hand end of the system. To provide this capability, the system includes a selectable branching device 100 is disposed adjacent the first entry conveyor means 96 on an opposite side of the exit path means 102 for selectively branching the tube support members 3 onto the first entry conveyor means 96 and a second selective branching means 101 disposed adjacent the second entry conveyor means 98 on an opposite side of the exit path means 102 for selectively guiding the tube support members 3 from the common exit path means 102 onto the second entry conveyor means 98. Each selective branching device 100, 101 is operatively connected by a connector 100', 101', respectively, to a control unit 90 for selective control of the operation of the selective branching means. Each selective branching device 100, 101 can be configured, for example, in the form of a hydraulically actuated gate 40, as illustrated in FIG. 2. As seen in FIG. 2, the hydraulically actuated gate 40 is in the form of an arm pivotally mounted to one of the guide channels 17 in which the belt 18 is supported. A driven arm 41 is fixedly secured at one end to the gate 40 and the other end of the driven arm 41 is movably connected to the free end of a piston 42. The piston 42 is selectively extendable from, and retractable into, a hydraulic cylinder 43 mounted to the frame of the textile winding machine and the hydraulic cylinder 43 is connected via a connector 43' to the control unit 90 for control of the operation of the gate 40. The gate 40 is normally maintained in a non-guiding position in which it extends generally parallel to the direction of travel of the belt 18 to permit clear passage therepast of the tube support members being transported on the belt 18. To dispose the gate 40 in its non-guiding position, the hydraulic cylinder 43 is controlled by the control unit 90 to retract the piston 42, thereby effecting pivoting of the gate 40 into its non-guiding position. In the event that an oncoming tube support member 3 is to be guided onto the entry conveyor means, the control unit 90 controls the hydraulic cylinder 43 to extend the piston 42, thereby effecting positioning of the gate 40 at an angle across the belt 18 and the oncoming tube support member 3 is thereafter transported against the gate 40 and guided thereby from the belt 18 onto the entry conveyor means.

To illustrate the operation of the system shown in FIG. 3 and, especially, its flexibility in differently handling empty tubes, partial feed packages and feed packages, the passage of a tube support member 3 through the system will now be described. As a starting point, the one tube support member 3 whose passage will be described is one of the tube support members supporting a feed package 4 and is positioned in a through-path 15 of the first textile winding machine. After the other tube support members 3 preceding the one tube support member 3 on the through-path 15 have been discharged from the winding location 67 of the winding unit, the one tube support member 3 is advanced along the through-path 15 to the winding location 67 for the winding of yarn from the feed package by the winding unit. Upon the completion of winding of the feed package, or in response to the occurrence of another event such as, for example, a yarn break situation in which the winding unit is unable to successfully engage a yarn end of the feed package 4 to thereby resume the winding operation, the one tube support member 3 is discharged from the winding location 67 and is advanced along the through-path 15 onto the common exit path means 102 for transport thereby in the direction shown by the arrow in FIG. 3. If it is desired to guide the tube support members 3 exiting the winding units of the first textile winding machine to the operator level support means thereof for the execution of exchange operations by an operator, the control unit 90 controls the selective branching device 100 to guide the oncoming one tube support member 3 between the pair of guide channels 97 of the first entry conveyor means 96 for subsequent transport thereby to the operator level support means associated with the first textile winding machine 1. On the other hand, if it is desired that the tube support members 3 be transported to the auxiliary handling components at the left hand end of the system, the control unit 90 controls the selective branching device 100 to remain in its nonguiding position, whereupon the one tube support member 3 travels therepast and shortly thereafter is transported past a remaining yarn sensor 106.

The remaining yarn sensor 106 is operable to distinguish between a tube having no remaining yarn thereon (e.g., an empty tube 5) and a tube having remaining yarn thereon (e.g., a partial feed package 6). If the remaining yarn sensor 106 senses the presence of remaining yarn on the tube supported on the one tube support member 3, the sensor transmits a signal via a connector 106' to a branching control device 107 which, in response thereto, transmits a signal via a connector 108' to a gate means 108. The gate means 108 responds to the signal from the branching control device 107 by moving to a guiding disposition at an angle across the travel path of the common exit path means 102 to thereby guide the one tube support member 3 onto a return belt 109 trained around a pair of guide rollers 109', 109''. A tube stripping sensor 112 is positioned adjacent the travel path of the return belt 109 for discriminating between those tubes traveling therepast having a remaining amount of yarn sufficient for recirculation of the feed package to a winding unit (a recirculable amount of yarn) and those tubes having less than a recirculable amount of yarn thereon. The tube stripping sensor 112 is operatively connected via a connector 112' to the control unit 90. A gate member 111 is disposed adjacent the travel path of the return belt 109 downstream of the tube stripping sensor 112 and is operatively connected via a connector 112' to a gate member 111 disposed adjacent the travel path of the return belt 109 downstream of the tube stripping sensor 112. The gate member 111 is operable to selectively guide the tube support members 3 onto a belt 114 in response to the sensing by the tube stripping sensor 112 of a tube traveling therepast having less than a recirculable amount of yarn or, alternatively, to permit the tube support member 3 to be further transported by the return belt 109 in response to the sensing by the tube stripping sensor 112 of a tube having a recirculable amount of yarn. The belt 114 is driven by a drive motor 115.

If the tube stripping sensor 112 senses that the tube supported on the one tube support member 3 has less than a recirculable amount of yarn thereon, the one tube support member 3 is guided by the gate member 111 onto the belt 114 for transport to and through a tube stripping device 113 which strips the remaining yarn from the tube.

The belt 114 then transports the one tube support member 3, which now supports an empty tube 5, from the tube stripping device 113 to a belt 116, which is trained around a guide roller 116'' and a drive roller 116'. The drive roller 116''is operatively connected to a drive motor 117 for driving operation of the belt 116. An arcuately-shaped guide member 118 extends across the travel path of the belt 116 at the downstream end of the belt 114 for guiding the tube support members 3 onto the belt 116.

The upstream end of the belt 116 is disposed adjacent the travel path of the common exit path means 102 at a location upstream of the remaining yarn sensor 106. Accordingly, the one tube support member 3 now supporting an empty tube 5 is transferred from the belt 116 to the common exit path means 102 and is subsequently again transported past the remaining yarn sensor 106. Since the tube supported on the one tube support member 3 is now an empty tube 5 having no remaining yarn, the remaining yarn sensor 106 controls the gate means 108 to remain in a clearance position to thereby permit further transport of the one tube support member 3 by the common exit path means 102 downstream of the gate means 108.

An arcuately-shaped guide member 119 extends transversely across the travel path of the return belt 109 at a location upstream of the gate member 111 for guiding those tube support members 3 not diverted onto the belt 114 from the return belt 109 onto a belt 120. The belt 120 is trained around a guide roller 120'' and a drive roller 120', which is operatively connected to a drive motor 121 for driving operation of the belt 120. An auxiliary yarn end disposing device 122 is disposed along the travel path of the belt 120 and is operatively connected via connector 123' to a gate member 123. The gate member 123 is disposed downstream of the auxiliary yarn end disposing device 122 relative to the direction of travel of the belt 120 and includes an arm movable from a clearance position clear of the travel path of the belt 120 to a diverting position transversely across the travel path of the belt for guiding movement of the tube support members 3 onto a belt 124. The belt 124 is trained around a guide roller 124'' and a drive roller 124', which is operatively connected to a drive motor 125 for driving operation of the belt 124. The upstream end of the belt 124 is positioned adjacent the common entrance path means 68 for transfer of the tube support members 3 thereto.

In the event that the one tube support member 3 supports a tube having a recirculable amount of yarn (e.g., it supports a partial feed package 6), the tube stripping sensor 112 controls the gate member 111 to remain in a clearance position in which it permits the return belt 109 to further transport the one tube support member 3 therealong and the guide member 119 thereafter guides the one tube support member 3 onto the belt 120 for transport to and through the auxiliary yarn end disposing device 122. The auxiliary yarn end disposing device 122 includes conventional yarn end preparation devices for effecting the loosening of a yarn end of a partial yarn package 6 and for disposing a loosened yarn end in a preferred disposition on the partial feed package for ready engagement thereof by one of the winding units of the first or second textile winding machines. Following the yarn end preparation of the partial feed package 6 supported thereon, the one tube support member 3 is further transported by the belt 120 beyond the auxiliary yarn end disposing device 122. If the auxiliary yarn end disposing device 122 has successfully disposed a yarn end of the partial feed package 6 in a preferred disposition, the auxiliary yarn end disposing device controls the gate member 123 via the connector 123' to guide the one tube support member 3 from the belt 120 onto the belt 124 for transport thereby to the common entrance path means 68. The one tube support member 3 is then further transported to the winding units of one of the first or second textile winding machines for a subsequent attempt to wind the yarn of the partial feed package 6.

In the event that the auxiliary yarn end disposing device 122 cannot successfully dispose a yarn end of the partial feed package 6 in a preferred disposition, the gate member 123 is controlled to remain in a clearance position in which it permits the belt 120 to transport the one tube support member 3 therepast. An arcuately-shaped guide member 126 extends transversely across the travel path of the belt 120 at a location downstream of the gate member 123 for guiding the tube support members 3 onto a storage belt 127. A stop member 129 extends transversely across the travel path of the storage belt 127 for preventing further downstream travel of the tube support members 3 supported on the belt 127. The belt 127 is trained around a conventional guide roller and a conventional drive roller, which is operatively connected to a drive motor 128 for driving operation of the belt 127.

The guide member 126 accordingly guides the one tube support member 3 from the belt 120 onto the belt 127 in the event that the auxiliary yarn end disposing device 122 has not successfully disposed a yarn end of the partial feed package 6 supported on the one tube support member in a preferred disposition. The one tube support member 3 is thereafter supported on the belt 127 in a waiting status along with other unsuccessfully prepared partial feed packages 6 so that an operator can conveniently access these feed packages to manually prepare or otherwise handle the feed packages.

In the event that the one tube support member 3 supports a tube whose remaining yarn has been stripped by the tube stripping device 113, the one tube support member 3 is eventually transferred by the common exit path means 102 to an end belt 131 which extends adjacent the downstream end of the common exit path means 102 and the upstream end of the common entrance path means 68. The end belt 131 is trained around a guide roller 131" and a drive roller 131', which is operatively connected to a drive motor 132 for driving operation of the end belt 131. An arcuately-shaped guide member 131''' extends transversely across the travel path of the end belt 131 adjacent the downstream end of the common exit path means 102 for guiding the tube support members 3 transferred to the end belt 131 onto the end belt. An empty tube transfer device 133 is disposed relative to the end belt 131 for transferring the empty tubes 5 supported on the tube support members 3 being transported by the end belt 131. A feed package transfer device 134 is disposed adjacent the end belt 131 at a location upstream of the empty tube transfer device 133 for transferring feed packages 4 from an interconnected feed package supply station or a textile spinning machine to empty tube support members 3 transported on the end belt 131. An arcuately-shaped guide member 68" extends transversely across the travel path of the end belt 131 adjacent the upstream end of the common entrance path means 68 for guiding the tube support members 3 supporting feed packages 4 from the end belt 131 to the common entrance path means 68.

In the event that the one tube support member 3 is transported downstream of the gate means 108, the tube support member is transferred from the common exit path means 102 to the end belt 131 and is guided by the guide member 131''' smoothly onto the end belt. The one tube support member is then temporarily stopped at the empty tube transfer device 133 for transfer of the empty tube 5 from the one tube support member to the interconnected feed package supply station or spinning machine. Thereafter, the end belt 131 further transports the now empty one tube support member 3 to the feed package transfer device 134 at which the one tube support member is temporarily stopped during the placement of a fresh feed package 4 thereon. The end belt 131 thereafter further transports the one tube support member 3 into guiding engagement with the guide member 68" for guiding of the tube support member onto the common entrance path means 68 at its upstream end.

A sensor 70 is positioned adjacent the travel path of the common entrance path means 68 and is operatively connected via a connector 70' to a sensor control unit 71, which itself is connected via a connector 71' to the control unit 90. A gate member 72 is operatively connected via a connector 72' to the sensor control unit 71 and includes an arm selectively movable between a clearance position clear of the travel path of the tube support members 3 being transported by the common entrance path means 68 and a diverting position in which the arm extends at an angle across the travel path of the tube support members for diverting the tube support members from the common entrance path means 68 to a first intermediate supply belt 77. The first intermediate supply belt 77 is trained around a guide roller 77" and a drive roller 77', which is operatively connected to a drive motor 78 for driving operation of the intermediate supply belt. A first support member 76 has a top surface for promoting sliding movement thereover of a tube support member 3 and the first support member 76 is disposed between the common entrance path means 68 and the intermediate supply belt 77 for permitting smooth passage thereover of a tube support member 3 being transferred from the common entrance path means to the intermediate supply belt.

The sensor 70 is operable to sense the type of marking which is affixed to the feed package 4 or the tube support member 3 traveling therepast, if it is desired to provide conventional markings each uniquely corresponding to a predetermined selection characteristic for distinguishing between, for example, feed packages produced in a particular batch. In response to the sensing of a marking or coding on, for example, a tube support member 3 by the sensor 70, the sensor control unit 71 controls the gate member 72 to move from its clearance position to its diverting position to divert each tube support member 3 supporting a feed package 4 of, for example, the same batch, onto the first support member 76 for sliding movement therealong onto the intermediate supply belt 77. If the sensor control unit 71 determines that a particular sensed tube support member 3 is supporting a feed package 4 which was not produced in the same batch as those feed packages 4 transferred to the intermediate supply belt 77, the sensor control unit 71 controls the gate member 72 to remain in its clearance position to thereby permit the common delivery path means 68 to further transport the tube support member 3 downstream.

A gate member 89 is disposed adjacent the travel path of the common delivery path means 68 and is operatively connected via a connector 89' to the control unit 90. A second support member 93 is disposed intermediate the common entrance path means 68 and a second intermediate supply belt 94, which is trained around a guide roller 94'' and a conventional drive roller (not shown) operatively connected to a drive motor (not shown}for driving operation of the belt 94. The gate member 89 is movable from a clearance position out of clearance with the travel path of the common delivery path means 68 and a diverting position for diverting those tube support members which have been transported downstream of the gate member 72 onto the support member 93 for sliding therealong onto the second intermediate supply belt 94.

The first intermediate supply belt 77 has a conventional yarn end preparation means 79 associated therewith for preparing the yarn ends of the feed packages 4 transported therealong. A transfer belt 80 is trained around a guide roller 80'' and a drive roller 80', which is operatively connected to a drive motor 82 for driving operation of the transfer belt 80. The transfer belt 80 extends generally transversely to the direction of travel of the first intermediate supply belt 77 adjacent the downstream end thereof to a location adjacent the upstream end of a final supply belt 83. An arcuately-shaped guide member 81 is positioned across the travel path of the transfer belt 80 adjacent the downstream end of the first intermediate supply belt 77 for guiding the tube support members 3 transferred from the intermediate supply belt to the transfer belt.

The final supply belt 83 extends transversely to the through-path 15 and is trained around a conventional guide roller (not shown) and a drive roller 83', which is operatively connected to a drive motor 84 for driving operation of the final supply belt 83. The upstream end of each through-path 15 is positioned adjacent the final supply belt 83 for the receipt of the tube support members 3 transferred from the final supply belt thereto. A time relay device 85 is operatively connected to the drive motor 84 for controlling the drive motor to cyclically reverse its rotation to thereby effect cyclic reversal of the direction of travel of the final supply belt 83. A stop member 87 is positioned transversely across the travel path of the final supply belt 83 at its end adjacent the transfer belt 80 and a stop member 86 is positioned transversely across the final supply belt 83 at a location intermediate the drive roller 83' and the respective through-path 15 most closely adjacent the drive roller 83'. The stop members 86, 87 operate to restrict the movement of the tube support members 3 to the extent of the final supply belt 83 between the stop members.

Those tube support members 3 which have been transported to the first intermediate supply belt 77 and subjected to a yarn end preparation operation by the yarn end preparation means 79 are guided by the guide member 81 onto the transfer belt 80 for transport thereby to the final supply belt 83. Under the control of the time relay device 85, the final supply belt 83 is driven in a cyclically reversing manner and this belt movement effects continuous movement of the tube support members 3 supported on the belt between the pair of stop members 86, 87. As space becomes available in each through-path 15, one of the tube support members 3 on the final supply belt 83 is automatically transferred thereto and the feed package 4 supported thereon subsequently undergoes a winding operation at the winding location 67 of the respective winding unit associated with the through-path 15.

The system illustrated in FIG. 3 can be automatically changed over from a configuration in which the tube support members 3 are commonly circulated through the auxiliary handling components on the left hand side of the system to a configuration system in which the tube support members 3 of each textile winding machine are circulated in a closed loop within the respective textile winding machine. To provide this flexibility, the system illustrated in FIG. 3 includes a first detour member 73 operatively connected via a connector 73' to the control unit 90. The first detour member 73 can be in the form of a conventional hydraulic cylinder and piston assembly or a conventional solenoid assembly and includes a selectively extendable and retractable arm 74. The first detour member 73 is disposed adjacent the travel path of the common delivery path means 68 generally opposite the support member 76. The system also includes a second detour member 91 operatively connected via a connector 91' to the control unit 90 and disposed adjacent the travel path of the common entrance path means 68 generally opposite the support member 93.

To change over the system to the configuration in which the tube support members 3 associated with each respective textile winding machine travel in a closed loop arrangement, the control unit 90 controls the first detour member 73 and the second detour member 91 to extend their respective arms 74, 91'' from a clearance position out of interference with the travel path of the common entrance path means 68 to a detour position extending at an angle across the travel path of the common entrance path means. Additionally, the control unit 90 controls the drive motor 69 to reverse the rotation of the entrance belt 75 and controls the gate member 100, 101 to move to their guiding positions across the travel path of the common exit path means 102. Additionally, the control unit 90 controls the gate members 72, 89 to remain in their clearance positions.

With the various gate members so controlled by the control unit 90, each textile winding machine is thereby provided with a closed loop transport arrangement in which the tube support members 3 continuously travel to and from the winding units of the respective textile winding machine without the mixing of tube support members from other textile winding machines. For example, the respective textile winding machine having its winding units on the left hand side of the return belt 105 in FIG. 3 operates as follows in a closed loop transport arrangement. Each tube support member 3 exiting a through-path 15 is transported by the common exit path means 102 into guiding engagement with the gate member 100 for guiding of the tube support member onto the entry conveyor means 96. After appropriate handling of the tube or feed package supported on the tube support member while the tube support member is transported along the respective operator level support means associated with the one textile winding machine, the tube support member 3 is conveyed by the return conveyor means 103 to the return belt 105. The return belt 105 transports the tube support member, which supports either a partial feed package 6 or a feed package 4, to the common entrance path means 68, whereat the delivery belt 75 thereof transports the tube support member 3 in the direction toward the left hand end of the system (due to the reversal of the direction of movement of the delivery belt 75). The tube support member is moved into guiding engagement with the extended arm 74 of the first detour member 73 and is thereby guided onto the support member 76 for sliding movement therealong onto the intermediate supply belt 77. The tube support member 3 thereafter is transported by the transfer belt 80 and the final supply belt 83 to one of the through-paths 15 for subsequent positioning of the tube support member at a winding location 67 of a winding unit.

The present invention also contemplates that the system illustrated in FIG. 3 can be modified to more advantageously accommodate certain winding operations. For example, the intermediate supply belt 77 and the second intermediate supply belt 94 can be replaced by a single belt extending across and between the two adjacent textile winding machines for commonly intermediately transporting the tube support members to both of the textile winding machines. Such a common intermediate supply belt could be configured in the form of a selectively reversible belt such as the final supply belt 83.

The present invention also contemplates that the operator level support means can be configured in the form of a magazine-type container instead of the arrangement including the belt 19 and the guide channel members 20 as shown in the embodiment illustrated in FIG. 1. In this other configuration, the entry conveyor means 22 would be operable to convey the tube support members 3 to the magazine-type container. Moreover, the present invention also contemplates that the system illustrated in FIG. 3 can be configured with a single operator level support means for operation in association with a plurality of textile winding machines arranged adjacent to one another. Also, the present invention contemplates that the operator level support means can be advantageously positioned at various locations relative to the textile winding machines such as, for example, at one longitudinal end of a textile winding machine.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A textile winding machine, comprising:

a plurality of winding units arranged in side by side manner along a longitudinal extent of the textile winding machine each for unwinding yarn form a feed package onto a winding package, each feed package including a body of textile yarn built on a tube;

a plurality of tube support members each for individually supporting a tube thereon in a generally fixed disposition relative to the tube support member;

a delivery transport assembly for delivering tube support members to the winding units for unwinding of yarn from the feed packages supported on the tube support members and including means forming a common entrance path and a plurality of through-path means each forming a through-path through a respective one of the winding units for transporting tube support members from the common entrance path through the respective winding unit, each throughpath having an upstream end adjacent the common entrance path and a downstream end from which tube support members are discharged from the winding units;

an exit transport assembly for transporting tube support members from the downstream ends of the through-paths and including at least one longitudinally extending exit path extending adjacent the downstream end of at least one through path, the downstream end of the at least one through path being at a predetermined longitudinal location, each tube support member being transported from a winding unit supporting a selected one of an empty tube, a partially unwound feed package and a full feed package, and the through-paths, the delivery transport assembly and the exit transport assembly all being located in substantially the same horizontal plane; and a feed package re-supply support assembly connected to the delivery transport assembly and the exit transport assembly, the feed package re-supply support assembly having a longitudinally extending operator level support means for supporting tube support members at a predetermined height above the horizontal plane, the predetermined height being selected to provide an operator with ready access to the tube support members supported on the operator level support means during manual tube and feed package handling operations performed by the operator, and at least a portion of the operator level support means being longitudinally coextensive with at least a portion of the one exit path such that the operator level support means and the one exit path are at least partially longitudinally coextensive, the longitudinally coextensive portion of the one exit path extending adjacent the downstream end of the at least one through-path, and the longitudinally coextensive portion of the operator level support means, the longitudinally coextensive position of the one exit path and the downstream end of the at least one through-path all being longitudinally coincident with one another at the predetermined longitudinal location of the downstream end such that tube support members exiting the one downstream end of the at lest one through-path travel in the horizontal plane along the longitudinally coextensive portion of the one exit path in longitudinally overlapping, vertically spaced relation to tube support members being supported at the predetermined height by the longitudinally coextensive portion of the operator level support means.

2. A textile winding machine according to claim 1 wherein the operator level support means includes a longitudinal portion extending adjacent the winding units on one longitudinal side of the textile winding machine.

3. A textile winding machine according to claim 2 wherein the at least one exit path includes a portion extending adjacent the winding units on the one longitudinal side of the textile winding machine and below the longitudinal portion of the operator level support means.

4. A textile winding machine according to claim 1 and further comprising a tube removing device disposed adjacent a selected one of the exit transport assembly and the feed package re-supply support assembly for selectively removing tubes from tube support members transported therepast.

5. A textile winding machine according to claim 4 and further comprising a sensor for distinguishing between a tube having less than a predetermined amount of yarn thereon and a tube having at least a predetermined amount of yarn thereon, and the tube removing device being operable to remove a tube in response to sensing by the sensor of the tube.

6. A textile winding machine according to claim 1 wherein the operator level support means includes an endless belt extending generally horizontally and having a top run positioned for supporting the tube support members at the predetermined height, and drive means for driving operation of the endless belt.

7. A textile winding machine according to claim 1 and further comprising an entry conveyor means for conveying tube support members from the at least one exit path to the operator level support means, the entry conveyor means including a vertical transport component having an endless member and a plurality of carrier members mounted to the endless member at generally uniform spacings therealong for supporting tube support members thereon, and means for driving the endless member in a vertical path.

8. A textile winding machine according to claim 7 wherein each tube support member includes an annular ring portion, a peg support portion concentric with the annular ring portion, and a plurality of spoke members fixedly interconnecting the annular ring portion to the peg support portion, and each adjacent pair of spoke members, the annular ring portion, and the peg support portion forming an engagement opening for the insertion therein of a carrier member for support of the tube support member by the carrier member.

9. A textile winding machine according to claim 7 and further comprising a tube removing device disposed adjacent the travel path of the tube support members being transported by the vertical transport component of the entry conveyor means for removing tubes from the tube support members during travel of the tube support members therepast.

10. A textile winding machine according to claim 9 wherein the tube removing device includes an arm selectively movable between a clearance position out of interference with the tubes traveling past the tube removing device and a tube removing position in which the arm is at an angle to the travel path of the tubes, the arm operating to engage a tube traveling therepast to block further travel of the tube while the respective tube support member supporting the tube continues to be transported past the arm by the vertical transport component, whereby the engaged tube is dislodged from its fixed disposition on the respective tube support member.

11. A textile winding machine according to claim 9 wherein the tube removing device includes a pair of rollers each having a roller axis, means for supporting each roller at a tube removing location adjacent the travel path of the tube support members being transported by the vertical transport component with the roller axis of each roller being aligned generally parallel to the direction of travel of the tube support members at the tube removing location and the pair of rollers being arranged generally parallel to one another and forming a roller gap therebetween, means for selectively varying the roller gap from a tube engaging spacing at which each roller engages a tube traveling between the rollers to effect removal of the tube and a clearance spacing at which the roller gap is sufficient to permit travel of a tube between the pair of rollers without engagement thereby, and means for driving each roller about its roller axis.

12. A textile winding machine according to claim 9 and further comprising a slide member and a tube container, the slide member having an upper end positioned adjacent the tube removing device and a lower end positioned adjacent the tube container, the slide member for guiding tubes removed by the tube removing device to the tube container for collection thereat.

13. A textile winding machine according to claim 7 and further comprising an auxiliary handling assembly connected to the exit transport assembly and the delivery transport assembly, the auxiliary handling assembly having an empty tube transfer device for transferring empty tubes supported on tube support members and a feed package transfer device for disposing feed packages onto empty tube support members, and means for selectively guiding the tube support members being transported by the exit transport assembly to a selected one of the entry conveyor means and the auxiliary handling assembly.

14. A textile winding machine according to claim 7 and further comprising a return conveyor means for conveying tube support members from the operator level support means to the delivery transport assembly, the return conveyor means including a vertical transport component having an endless member, a plurality of carrier members mounted to the endless member at generally uniform spacings therealong for supporting tube support members thereon, and means for driving the endless member in a vertical path.

15. A textile winding machine according to claim 14 wherein the operator level support means includes a generally horizontally extending endless belt and further comprising synchronous driving means, connected to the endless members of the vertical transport components of the entry conveyor means and the return conveyor means and to the endless belt of the operator level support means for synchronously driving the endless members.

16. A textile winding machine according to claim 14 wherein the operator level support means includes a generally horizontal endless belt, means for driving the endless belt to effect transport of the tube support members from the entry conveyor means to the return conveyor means, and stop means for selectively preventing the travel of tube support members past a stop location intermediate the entry conveyor means and the return conveyor means.

17. A textile winding machine according to claim 16 wherein the stop means includes an arm and a sensor for distinguishing between a tube supported on a tube support member having less than a predetermined amount of yarn and a tube supported on a tube support member having at least the predetermined amount of yarn, and means for selectively positioning the arm in the travel path of the tube support members on the endless belt to prevent the travel therepast of the tube support members, the means for selectively positioning the arm being responsive to the sensing by the sensor of a tube having less than the predetermined amount of yarn to extend the arm in the travel path of the tube support members.

18. A textile winding machine according to claim 1 and further comprising a yarn end preparation device positioned adjacent the delivery transport assembly for disposing the yarn ends of the feed packages transported thereto in a preferred disposition for subsequent engagement of the yarns ends by the winding unit during unwinding of the feed packages at the winding units.

19. A textile winding machine according to claim 1 wherein the means forming a common entrance path includes an endless belt and means for selectively reversing the direction of travel of the endless belt, and stop means including a pair of spaced apart stop arms for limiting the travel of the tube support members supported on the endless belt to the extent of the endless belt between the stop arms.

20. A textile winding machine according to claim 1 and further comprising an entry conveyor means for vertically conveying tube support members from the at least one exit path to the operator level support means and a return conveyor means for vertically conveying tube support members from the operator level support means to the delivery transport assembly.

* * * * *